US008264131B2

(12) United States Patent
Sakayanagi et al.

(10) Patent No.: US 8,264,131 B2
(45) Date of Patent: Sep. 11, 2012

(54) SPARK PLUG

(75) Inventors: Nobuaki Sakayanagi, Toyohashi (JP); Katsutoshi Nakayama, Toyohashi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 13/143,220

(22) PCT Filed: Aug. 23, 2010

(86) PCT No.: PCT/JP2010/005160

§ 371 (c)(1),
(2), (4) Date: Jul. 5, 2011

(87) PCT Pub. No.: WO2011/092758

PCT Pub. Date: Aug. 4, 2011

(65) Prior Publication Data

US 2012/0025691 A1 Feb. 2, 2012

(30) Foreign Application Priority Data

Jan. 26, 2010 (JP) ..... 2010-014121

(51) Int. Cl.
*H01T 13/20* (2006.01)

(52) U.S. Cl. ..... 313/141; 445/7; 313/142; 313/143

(58) Field of Classification Search ..... 313/118–145; 123/32, 41, 143 R, 146.5 R, 169 P, 260, 280, 123/169 R, 169 EL, 310; 445/7; 219/121.6, 219/121.64

See application file for complete search history.

(56) References Cited

U.S. PATENT DOCUMENTS

| | | | |
|---|---|---|---|
| 2002/0105254 | A1 | 8/2002 | Hori et al. |
| 2007/0290593 | A1 | 12/2007 | Kowalski |
| 2009/0134764 | A1 | 5/2009 | Kameda et al. |
| 2009/0140624 | A1 | 6/2009 | Kameda et al. |

FOREIGN PATENT DOCUMENTS

| | | | |
|---|---|---|---|
| JP | 2002-093547 | A | 3/2002 |
| JP | 2002-237365 | A | 8/2002 |
| JP | 2004-095214 | A | 3/2004 |
| JP | 2005-158323 | A | 6/2005 |
| JP | 2009-158437 | A | 7/2009 |
| JP | 2009-541946 | A | 11/2009 |
| JP | 2009-295569 | A | 12/2009 |

*Primary Examiner* — Mariceli Santiago
*Assistant Examiner* — Donald Raleigh
(74) *Attorney, Agent, or Firm* — Sughrue Mion, PLLC

(57) ABSTRACT

Peeling resistance of a noble metal chip is improved by reducing a difference in the thermal stress generated between the noble metal chip and a ground electrode. A spark plug 1 includes an insulator 2, a center electrode 5, a metal shell 3, and a ground electrode 27, wherein a spark discharge gap 33 is formed between the center electrode 5 and the noble metal chip 41 bonded to the ground electrode 27. The ground electrode 27 is provided with a concave hole portion 43, and 70% or more of the noble metal chip 41 is bonded to the hole portion 43 of the ground electrode 27 through a fusion portion 35 formed by fusing the noble metal chip and the ground electrode 27 to each other by emitting a laser beam or the like from the side surface of the noble metal chip. A gap 45 is formed between the noble metal chip 41 and at least a part of an inner wall surface 43 S of the hole portion 43 so as to be more than 0 mm and equal to or less than 1.0 mm in the direction perpendicular to the central axis CL2 of the noble metal chip 41.

10 Claims, 16 Drawing Sheets

SPARK PLUG

TECHNICAL FIELD

The present invention relates to a spark plug that is used in an internal combustion engine and the like.

BACKGROUND ART

A spark plug used in a combustion device such as an internal combustion engine includes, for example, a center electrode that extends in the axial direction, an insulating body that is provided in the outer periphery of the center electrode, a cylindrical metal shell that is assembled to the outside of the insulating body, and a ground electrode that has a base end portion bonded to the leading end portion of the metal shell. The ground electrode is curved at the substantially middle portion thereof so that its leading end portion faces the leading end portion of the center electrode. Accordingly, a spark discharge gap is formed between the leading end portion of the center electrode and the leading end portion of the ground electrode.

Further, in recent years, a technology has been introduced which bonds a noble metal chip to a portion provided with the spark discharge gap in the leading end portion of the ground electrode in order to improve wear resistance. As a technology of bonding the noble metal chip, for example, a method is suggested which forms a fusion portion used to fuse a noble metal chip and a ground electrode to each other by laser welding, and bonds the noble metal chip and the ground electrode to each other through the fusion portion (for example, Patent document 1 and the like).

However, the fusion portion has wear resistance worse than that of the noble metal chip. Further, since a minute uneven portion may be formed on the surface of the fusion portion, a spark discharge is generated between the center electrode and the uneven portion having a comparatively large electrical field strength, so that there is a concern in that ignition performance may be degraded. Accordingly, from the viewpoint of preventing degradation of the ignition performance or the wear resistance, it is desirable that the fusion portion is exposed to the side of the spark discharge gap as little as possible. Therefore, a technology is suggested which forms a concave portion in a ground electrode, disposes a noble metal chip in the concave portion to be buried therein, and emits a laser beam from the side surface of the ground electrode toward the buried portion of the noble metal chip, so that the fusion portion is suppressed from being exposed to the side of the spark discharge gap (for example, refer to Patent document 2 and the like).

RELATED ART DOCUMENT

Patent Document

[Patent document 1] Japanese Patent Publication No. 2005-158323-A

[Patent document 2] Japanese Patent Publication No. 2004-95214-A

SUMMARY OF INVENTION

Problem that the Invention is to Solve

However, in the technology disclosed in Patent document 2, the entire side surface of the base end portion of the noble metal chip is closely surrounded by the inner wall surface of the concave portion. For this reason, at the time of using (heating) the spark plug, the thermal expansion toward the side surface of the noble metal chip is regulated due to the presence of the inner wall surface of the concave portion. As a result, a large difference occurs in the thermal expansion degree between the noble metal chip and the ground electrode, so that there is a concern in that a difference in the thermal stress between the noble metal chip and the ground electrode may increase. When a difference in the thermal stress increases, there is a concern in that a crack (oxidized scale) is generated at a boundary portion between the noble metal chip and the ground electrode, and the noble metal chip is peeled off from its bonded portion.

The invention is made in view of the above-described circumstances, and an object of the invention is to provide a spark plug capable of improving peeling resistance of a noble metal chip by reducing a difference in thermal stress generated between a noble metal chip and a ground electrode.

Means for Solving the Problem

Hereinafter, the configuration appropriate for achieving the above-described object will be described in accordance with each item. Further, if necessary, the corresponding configuration will be described together with the specific effect thereof.

Configuration 1

According to the present configuration, there is provided a spark plug comprising: a cylindrical insulating body which has an axial hole penetrating the cylindrical insulating body in an axial direction; a center electrode which is inserted to a leading end side of the axial hole; a cylindrical metal shell which is provided in an outer periphery of the insulating body; a ground electrode which is disposed at a leading end portion of the metal shell; and a noble metal chip which is bonded to a leading end portion of the ground electrode and forms a spark gap between the noble metal chip and a leading end portion of the center electrode, wherein the ground electrode has a hole corresponding portion with a concave hole portion in at least one of a leading end surface and a side surface of the leading end portion of the ground electrode, wherein 70% or more of a bottom surface of the noble metal chip is bonded to the hole portion of the ground electrode through a fusion portion formed by fusing the noble metal chip and the ground electrode to each other by irradiating a laser beam or an electron beam from a side surface of the noble metal chip, and wherein a space gap is provided between the noble metal chip and at least a part of an inner wall surface of the hole portion so as to be more than 0 mm and equal to or less than 1.0 mm in a direction perpendicular to a central axis of the noble metal chip.

Further, the configuration 1 is particularly advantageous in that the noble metal chip causes a comparatively large difference in the thermal stress with respect to the ground electrode, in other words, the noble metal chip has a comparatively large (for example, 1.0 $mm^2$ or more) area forming the gap.

Configuration 2

According to the spare plug of the present configuration, in the above described configuration 1, the ground electrode has a body portion which is a portion except for the hole corresponding portion, wherein the fusion portion is a portion irradiated with the laser beam or the electron beam, and has an exposed surface exposed to the surface of the ground electrode, and wherein at least a part of a portion located at an opposite side of the exposed surface in the fusion portion in relation to an end portion at a side of the exposed surface of the noble metal chip in a direction perpendicular to the exposed surface intrudes into the body portion.

Configuration 3

According to the spark plug of the present configuration, in the configuration 2, a maximum value of a distance between a surface at a side of the spark gap in a surface of the body portion and an edge portion of the portion intruding into the body portion in the fusion portion in the direction along the central axis of the noble metal chip is set to be 0.05 mm or more.

Configuration 4

According to the spark plug of the present configuration, in the configuration 2 or 3, a maximum value of a distance between the inner wall surface of the hole portion and the edge portion of the portion intruding into the body portion in the fusion portion in the direction perpendicular to the central axis of the noble metal chip is set to be 0.05 mm or more.

Configuration 5

According to the spark plug of the present configuration, in any one of the configuration 1 to 4, the ground electrode is bent from a bent portion toward the center electrode, and wherein the fusion portion is formed at a leading end side of the ground electrode in relation to the bent portion.

Configuration 6

According to the spark plug of the present invention, in any one of the configuration 1 to 5, the fusion portion is not exposed on a surface except for the surface provided with the hole portion and a surface irradiated with the laser beam or the electron beam in the leading end surface and the side surface of the ground electrode.

Configuration 7

According to the spark plug of the present invention, in any one of the configuration 1 to 6, the fusion portion is not exposed to a surface provided with the gap in the noble metal chip.

Configuration 8

According to the spark plug of the present invention, in any one of the configuration 1 to 7, the gap is formed with respect to the noble metal chip in the inner wall surface of the hole portion, and at least a part of the surface connected to the surface of the body portion is provided with a tapered portion gradually becoming closer to the noble metal chip as it goes toward the bottom surface of the hole portion, and wherein an angle at a side of the ground electrode is set to an obtuse angle in an angle formed by an outline of the body portion and an outline of the tapered portion in a cross-section including the central axis of the noble metal chip.

Further, it is desirable that the angle formed by the outline of the body portion and the outline of a tapered portion is set to be large in the cross-section including the central axis of the noble metal chip from the viewpoint of further improving the ignition performance. Accordingly, it is desirable that the angle is set to 95° or more, and it is more desirable that the angle is set to 100° or more.

Configuration 9

According to the spark plug of the present configuration, in any one of the configuration 1 to 8, the ground electrode has the body portion which is the portion except for the hole corresponding portion, and wherein a surface of the body portion is connected to at least a part of the surface provided with the gap formed with respect to the noble metal chip in the inner wall surface of the hole portion through a convex curved surface portion.

Further, it is desirable that the curvature radius of the curved surface portion is set to be large in order to further improve the ignition performance. Accordingly, it is desirable that the curvature radius of the curved surface portion is set to 0.1 mm or more in the cross-section including the central axis of the noble metal chip, and it is more desirable that the curvature radius is set to 0.2 mm or more in the cross-section including the central axis of the noble metal chip.

Configuration 10

According to the spark plug of the present configuration, in any one of the configuration 1 to 9, the laser beam is a fiber laser.

Effect of the Invention

According to the spark plug of the configuration 1, the ground electrode has a concave hole portion, and the noble metal chip is bonded to the hole portion of the ground electrode through the fusion portion formed by emitting a laser beam or the like from the side surface thereof. Accordingly, the fusion portion may be suppressed from being exposed to the gap (the spark discharge gap), and degradation of the wear resistance or the ignition performance may be more reliably prevented.

Further, according to the spark plug of the configuration 1, 70% or more of the bottom surface of the noble metal chip is bonded to the ground electrode. That is, the sufficiently wide fusion portion is interposed between the bottom surface of the noble metal chip and the ground electrode. Accordingly, a difference in the thermal stress generated between the noble metal chip and the ground electrode in accordance with the thermal expansion may be more reliably absorbed by the fusion portion.

Further, since a gap (space) is formed between the noble metal chip and at least a part of the inner wall surface of the hole portion, the noble metal chip may be thermally expanded toward the side surface thereof at the time of using (heating) the spark plug. Accordingly, a difference in the thermal stress generated between the noble metal chip and the ground electrode may be more reliably reduced.

On the other hand, since the size of the gap is set to 1.0 mm or less in the direction perpendicular to the central axis of the noble metal chip so as not to become excessively large, heat may be more efficiently transferred from the noble metal chip to the ground electrode. As a result, a difference in the thermal stress generated between the noble metal chip and the ground electrode may be further reduced.

That is, according to the spark plug of the configuration 1, since the gap is provided, the noble metal chip may be thermally expanded toward its side surface. Since the gap is prevented from becoming excessively large, the heat of the noble metal chip may be efficiently transferred. Accordingly, a difference in the thermal stress between the noble metal chip and the ground electrode may be sufficiently reduced, and a difference in the thermal stress may be effectively absorbed by the comparatively wide fusion portion. As a result, the generation of oxidized scale at the boundary portion between the noble metal chip and the ground electrode may be more reliably prevented, and the peeling resistance of the noble metal chip may be noticeably improved.

According to the spark plug of the configuration 2, at least a part of a portion located at the opposite side of the exposed surface in the fusion portion is formed to intrude into the body portion of the ground electrode. That is, the edge portion of the fusion portion is held by the body portion. For this reason, the thermal expansion of the fusion portion may be effectively suppressed at the time of using the spark plug, and a difference in the thermal stress generated between the fusion portion and the ground electrode may be reduced. As a result, the generation of oxidized scale between the fusion portion and the ground electrode may be further suppressed, and the peeling resistance may be further improved.

According to the spark plug of the configuration 3, the maximum value of the distance along the central axis of the noble metal chip between the surface at the gap side of the body portion and the edge portion of the portion intruding into the body portion in the fusion portion is set to 0.05 mm or more. That is, the edge portion of the fusion portion is formed to be sufficiently disposed inside the body portion in relation to the surface of the body portion. For this reason, the edge portion of the fusion portion may be more reliably held by the body portion, and the thermal expansion of the fusion portion may be more reliably suppressed. As a result, the peeling resistance may be further improved.

According to the spark plug of the configuration 4, the maximum value of the distance along the direction perpendicular to the central axis of the noble metal chip between the inner wall surface of the hole portion and the edge portion of the portion intruding into the body portion of the fusion portion is set to 0.05 mm or more. That is, the edge portion of the fusion portion is formed to be sufficiently disposed on the inside of the inner wall surface of the hole portion. Accordingly, the distance from the boundary portion (in other words, oxygen intrusion position) between the fusion portion and the inner wall surface of the hole portion to the position (for example, a portion depicted by the bold line in FIGS. 8(*a*) and (*b*) and serving as an important portion ensuring the peeling resistance of the noble metal chip) located at the opposite side of the noble metal chip in the boundary portion between the ground electrode and the fusion portion may be set to be sufficiently large. Accordingly, the generation of oxidized scale at the boundary portion may be effectively prevented, and the peeling resistance may be further improved.

It is desirable that the maximum value of the distance between the inner wall surface of the hole portion and the edge portion of the fusion portion is set to be large in order to further improve the peeling resistance improving effect using the spark plug of the configuration 4. However, when the fusion portion becomes excessively larger as the distance increases, so that the fusion portion reaches the bent portion of the ground electrode, the wear resistance of the ground electrode with respect to a vibration or the like may be degraded.

For this reason, according to the spark plug of the configuration 5, the fusion portion is located at the leading end side of the ground electrode in relation to the bent portion thereof, that is, the fusion portion is formed so as not to reach the bent portion. For this reason, degradation of the wear resistance of the ground electrode may be more reliably prevented.

According to the spark plug of the configuration 6, since the exposed portion of the fusion portion toward the surface of the ground electrode is set to be small, degradation of the ignition performance or the wear resistance may be more reliably prevented.

According to the spark plug of the configuration 7, the fusion portion having wear resistance worse than that of the noble metal chip is not exposed to the discharge surface. For this reason, the wear resistance improving effect using the noble metal chip may be more reliably exhibited.

According to the spark plug of the configuration 8, the tapered portion is provided in the inner wall surface of the hole portion, and an angle formed by the connection portion between the tapered portion and the body portion is set to an obtuse angle. For this reason, the electric field strength of the connection portion may be reduced, and abnormal spark discharge between the connection portion and the center electrode may be more reliably prevented. As a result, the ignition performance may be improved.

According to the spark plug of the configuration 9, since the inner wall surface of the hole portion is connected to the body portion through the curved surface portion, abnormal spark discharge between the ground electrode and the center electrode may be more reliably prevented. As a result, the ignition performance may be improved.

According to the spark plug of the configuration 10, since the fiber laser is used as the laser beam, the fusion portion may be formed to be closer to the inside of the ground electrode while maintaining the fusion portion to be comparatively thin. For this reason, even when the fusion portion is formed in the comparatively large area as described above, the volume of the fusion portion may be set to be comparatively small. Accordingly, a melted portion in the noble metal chip when bonding the noble metal chip may be further decreased. Even when the comparatively thin noble metal chip is used, the noble metal chip may have a sufficient thickness (volume) after the bonding. That is, according to the configuration 10, since the noble metal chip having a comparatively thin thickness (for example, a thickness of 0.5 mm or less) is used, an increase in the manufacturing cost may be suppressed, and the wear resistance may be improved.

BRIEF DESCRIPTION OF DRAWINGS

FIG. 3 is a partially cutaway enlarged cross-sectional view illustrating a configuration of a noble metal chip, a ground electrode, or the like.

EXEMPLARY EMBODIMENTS FOR CARRYING OUT THE INVENTION

First Embodiment

Figure 1:
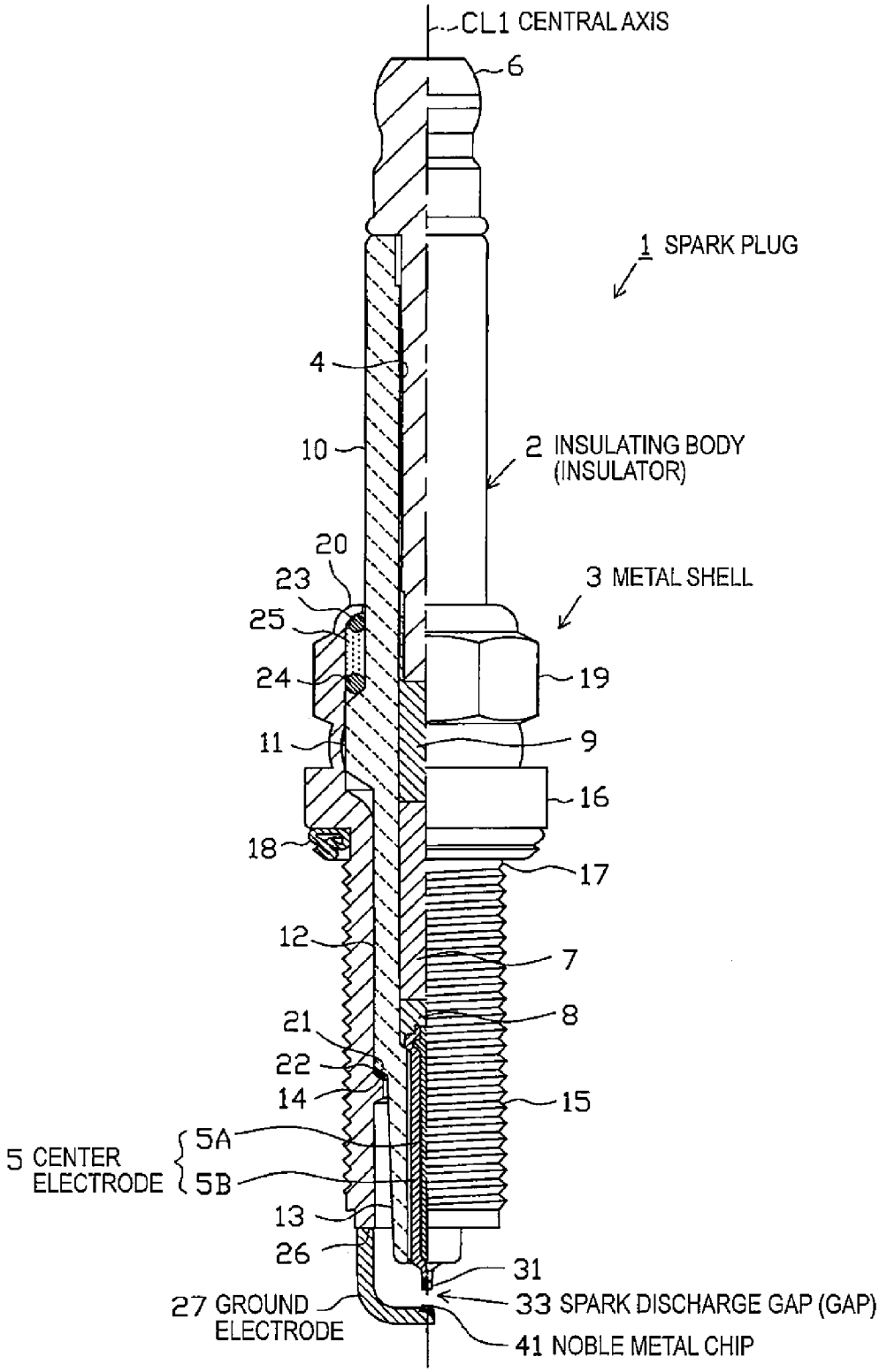
FIG. 1 is a partially cutaway front view illustrating a configuration of a spark plug.

Hereinafter, an embodiment of the invention will be described by referring to the drawings. FIG. 1 is a partially cutaway front view illustrating a spark plug 1. Further, in FIG. 1, the direction of the central axis CL1 of the spark plug 1 is described as the up/down direction of the drawing, the lower side is described as the leading end side of the spark plug 1, and the upper side is described as the rear end side thereof.

The spark plug 1 includes an insulator 2 which is a cylindrical insulator, a cylindrical metal shell 3 which holds the insulator, and the like.

As is well known, the insulator 2 is formed by baking alumina or the like at a high temperature, and includes: a rear end side body portion 10 which is formed at the rear end side of the external shape; a large diameter portion 11 which is disposed at the leading end side in relation to the rear end side body portion 10 and protrudes outward in the radial direction; a middle body portion 12 which is disposed at the leading end side in relation to the large diameter portion and has a diameter smaller than that of the large diameter portion 11; and a long leg portion 13 which is disposed at the leading end side in relation to the middle body portion 12 and has a diameter smaller than that of the middle body portion 12. Further, the large diameter portion 11, the middle body portion 12, and most of the long leg portion 13 in the insulator 2 are accommodated inside the metal shell 3. Then, the connection portion between the middle body portion 12 and the long leg portion 13 is provided with a tapered step portion 14, and the insulator 2 is locked to the metal shell 3 at the step portion 14.

An axial hole 4 penetrates the insulator 2 along the central axis CL1, and a center electrode 5 is inserted and fixed to the leading end side of the axial hole 4. The center electrode 5 includes an inner layer 5A which is formed of copper or copper alloy having excellent thermal conductivity and an outer layer 5B which is formed of Ni alloy mainly containing nickel (Ni). The center electrode 5 is formed in a bar shape (column shape) as a whole, where the leading end is formed to be flat, and the center electrode protrudes from the leading end portion of the insulator 2. Further, the leading end portion of the center electrode 5 is provided with a noble metal portion 31 that is formed of predetermined noble metal alloy (for example, platinum alloy or iridium alloy).

Further, a terminal electrode 6 is inserted and fixed to the rear end side of the axial hole 4 so as to protrude from the rear end of the insulator 2.

A columnar resistor 7 is disposed between the terminal electrode 6 and the center electrode 5 of the axial hole 4. Both end portions of the resistor 7 are respectively and electrically connected to the center electrode 5 and the terminal electrode 6 through conductive glass seal layers 8 and 9.

Further, the metal shell 3 is formed of metal such as low-carbon steel so as to have a cylindrical shape, and its outer peripheral surface is provided with a screw portion (male screw portion) 15 that is used to attach the spark plug 1 to an attachment hole of a combustion device (for example, an internal combustion engine, a fuel battery reformer, or the like). Further, the outer peripheral surface of the rear end side of the screw portion 15 is provided with a seat portion 16, and an annular gasket 18 is fitted into a screw neck portion 17 of the rear end of the screw portion 15. The rear end side of the metal shell 3 is provided with a tool engagement portion 19 that has a hexagonal cross-section and is used to allow the metal shell 3 to engage with a tool such as a wrench when the metal shell is attached to the combustion device, and a caulking portion 20 that is used to hold the insulator 2 at the rear end portion thereof.

Further, the inner peripheral surface of the metal shell 3 is provided with a tapered step portion 21 that is used to lock the insulator 2. Then, the insulator 2 is inserted from the rear end side of the metal shell 3 toward the leading end side thereof, and is fixed by caulking an open portion of the rear end side of the metal shell 3 toward the inside of the radial direction, that is, forming the caulking portion 20 while the step portion 14 is locked to the step portion 21 of the metal shell 3. Further, an annular plate packing 22 is interposed between the step portions 14 and 21 of both the insulator 2 and the metal shell 3. Accordingly, air-tightness inside a combustion chamber is maintained, and a fuel gas enclosed between a gap between the inner peripheral surface of the metal shell 3 and the long leg portion 13 of the insulator 2 exposed to the inside of the combustion chamber does not leak to the outside.

In order to more completely maintain the hermetic state of the caulking, annular members 23 and 24 are interposed between the metal shell 3 and the insulator 2 at the rear end side of the metal shell 3, and a gap between the annular members 23 and 24 is filled with powder of talc (talcum) 25. That is, the metal shell 3 holds the insulator 2 through the plate packing 22, the annular members 23 and 24, and the talc 25.

Figure 2:
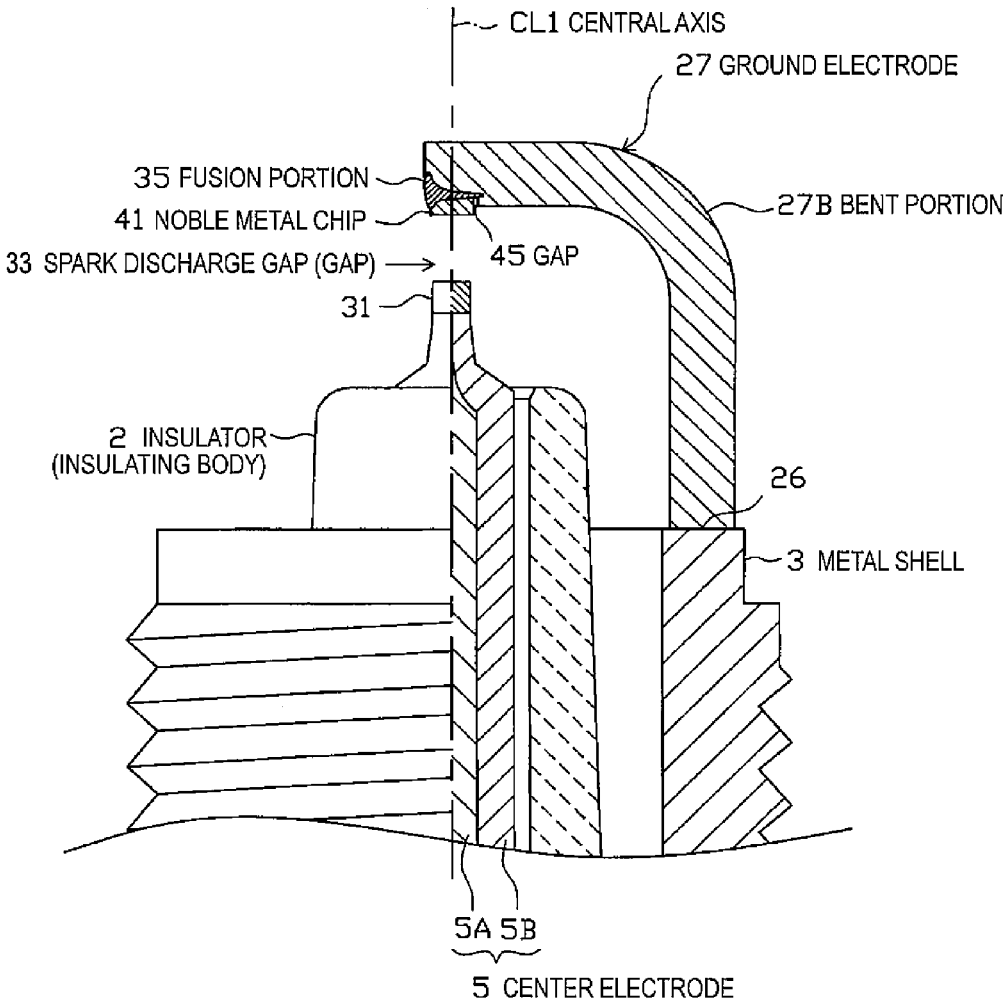
FIG. 2 is a partially cutaway enlarged front view illustrating a configuration of a leading end portion of the spark plug.

Further, as shown in FIG. 2, a ground electrode 27 is bonded to a leading end portion 26 of the metal shell 3 so as to be bent back at a bent portion 27B located at the substantially center portion thereof and to allow the side surface of the leading end side thereof to face the leading end portion (the noble metal portion 31) of the center electrode 5. The ground electrode 27 is formed of alloy that contains Ni as a main component and at least one of silicon, aluminum, and rare earth. Further, the columnar noble metal chip 41 is bonded to a portion facing the noble metal portion 31 in the ground electrode 27. The noble metal chip 41 is formed of noble metal alloy that contains at least one of iridium, platinum, rhodium, ruthenium, palladium, and rhenium.

Further, a spark discharge gap 33 is formed as a gap between the noble metal portion 31 and the leading end surface (discharge surface) of the noble metal chip 41, and a spark discharge is performed in the direction along the central axis CL1 in the spark discharge gap 33. Further, in the embodiment, the noble metal chip 41 is formed to be comparatively thin (for example, 0.5 mm or less) so as to suppress an increase in the manufacturing cost, and the area of the leading end surface (discharge surface) is formed to be comparatively large (for example, 1.0 $mm^2$ or more) in order to improve the wear resistance.

Figure 3:
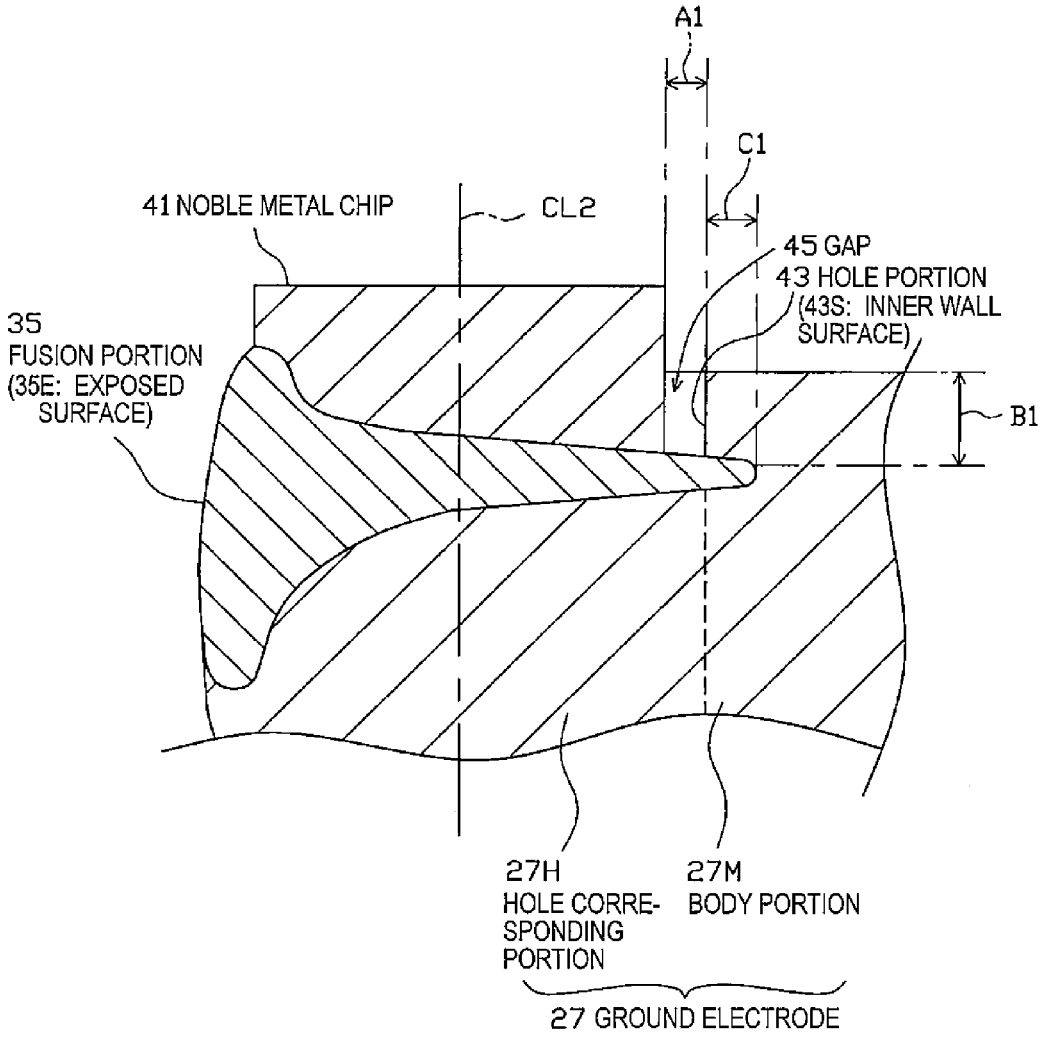
Figure 4A:
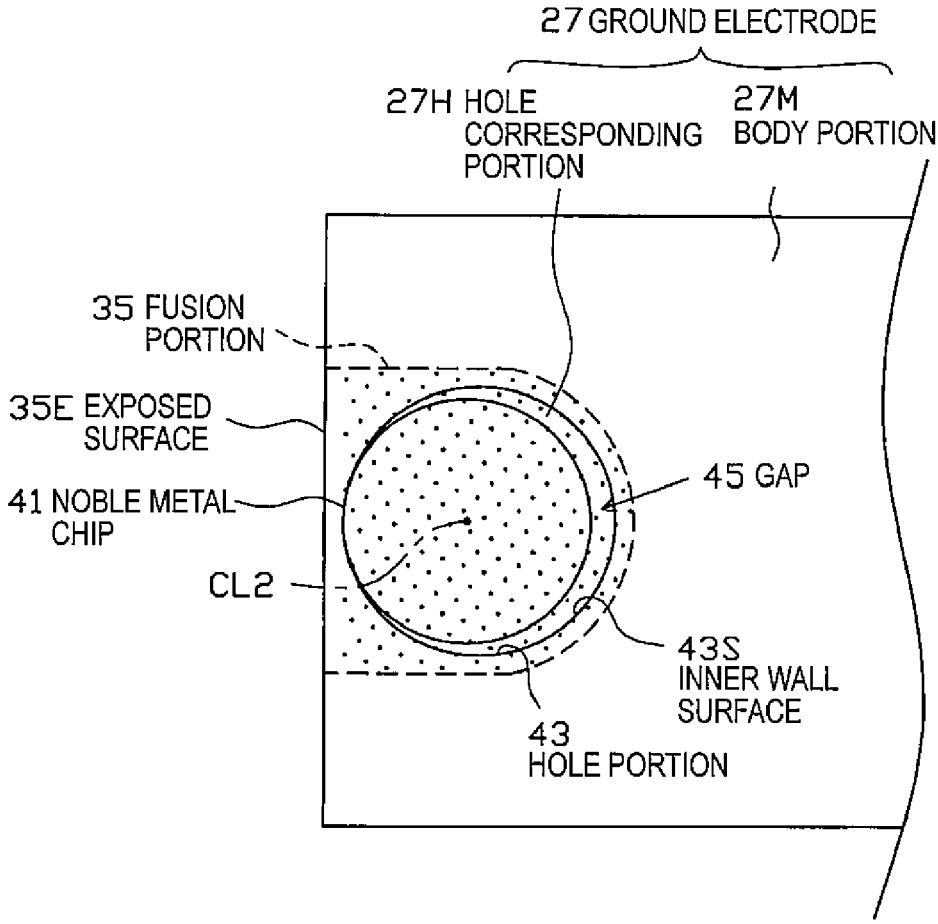
FIG. 4(*a*) is a figure showing a partially enlarged plan view illustrating a configuration of a leading end portion of the ground electrode, and FIG. 4(*b*) is a figure showing a partially enlarged cross-sectional view illustrating a cross-sectional shape of the leading end portion of the ground electrode.
Figure 4B:
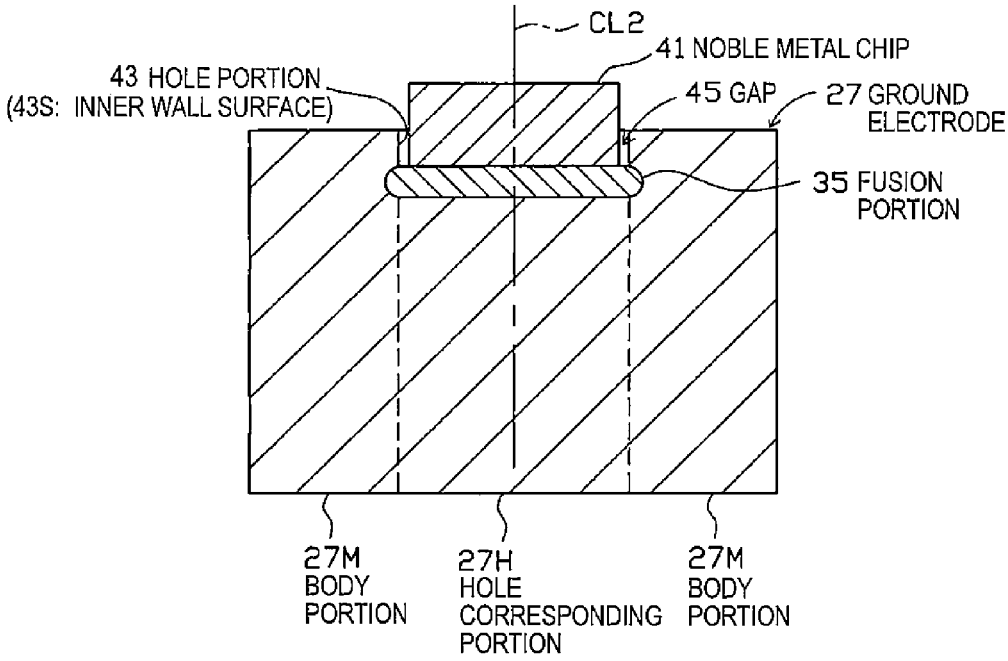

In the embodiment, as shown in FIGS. 3 and 4, the noble metal chip 41 is bonded to a bottom surface of a hole portion 43 provided on the side surface of the ground electrode 27. Then, the noble metal chip 41 is bonded through a fusion portion 35 formed by fusing the noble metal chip and the ground electrode 27, and 70% or more (in the embodiment, 100%) of the bottom surface (the rear surface of the discharge surface) of the noble metal chip 41 is bonded to the ground electrode 27.

Further, the ground electrode 27 includes a hole corresponding portion 27H that corresponds to the hole portion 43 and a body portion 27M that is a portion except for the hole corresponding portion 27H. Here, the hole corresponding portion 27H indicates a portion that is located inside a substantially columnar region formed by moving a portion located at the rear surface side of the hole portion 43 in the inner wall surface 43S of the hole portion 43 along the central axis CL2 of the noble metal chip 41 in the ground electrode 27.

Further, a gap 45 is provided between the noble metal chip 41 and at least a part of the inner wall surface 43S of the hole portion 43. Further, the size A1 of the gap 45 in the direction perpendicular to the central axis CL2 of the noble metal chip 41 is set to be more than 0 mm and equal to or less than 1.0 mm (for example, the range equal to or more than 0.01 mm and equal to or less than 0.5 mm).

Further, the fusion portion 35 is formed by emitting a laser beam (in the embodiment, fiber laser) or an electron beam from the side surface of the noble metal chip 41 toward the leading end surface of the ground electrode 27. Then, the fusion portion 35 is a position to which the laser beam or the like is emitted, where the thickness of the outside portion abruptly decreases inward from an exposed surface 35E exposed to the leading end surface of the ground electrode 27, and a decrease amount of the thickness of the inside portion becomes smaller.

In the embodiment, at least a part (in the embodiment, the entire edge portion of the fusion portion 35) of the fusion portion 35 (a portion depicted by the dotted pattern in FIG. 4(*a*)) located at the opposite side of the exposed surface 35E in the direction perpendicular to the exposed surface 35E in relation to the end portion located at the side of the exposed surface 35E in the noble metal chip 41 intrudes into the body portion 27M of the ground electrode 27.

Further, the maximum value of the distance B1 along the central axis CL2 of the noble metal chip 41 between the surface located at the side of the spark discharge gap 33 in the body portion 27M and the edge portion of the portion intruding into the body portion 27M in the fusion portion 35 is set to be 0.05 mm or more.

Further, the maximum value of the distance C1 along the central axis CL2 of the noble metal chip 41 between the inner wall surface 43S of the hole portion 43 and the edge portion of the portion intruding into the body portion 27M in the fusion portion 35 is set to be 0.05 mm or more.

However, in the embodiment, the fusion portion 35 is formed so that the maximum value of the distance C1 is comparatively small (for example, 1.0 mm or less). For this reason, the fusion portion 35 is formed to be closer to the leading end side of the ground electrode 27 than the bent portion 27B of the ground electrode 27 (in other words, the fusion portion 35 does not reach the bent portion 27B). Further, the fusion portion 35 is formed so as not to be exposed to the surface to which the laser beam or the like is emitted and the surface provided with the hole portion 43 in the leading end surface and the side surface of the ground electrode 27.

As described above, since particularly the inside portion of the fusion portion 35 is formed to be thin, the fusion portion 35 is not exposed to the discharge surface of the noble metal chip 41 even if the noble metal chip 41 is comparatively thin.

Next, a method of manufacturing the spark plug 1 having the above-described configuration will be described. First, the metal shell 3 is processed in advanced. That is, an outline and a perforation hole are formed in a columnar metal material (for example, an iron-based material or a stainless material) by cold forging. Subsequently, cutting is performed on the resultant object so as to arrange the external shape thereof, thereby obtaining a metal shell intermediate body.

Subsequently, the direct bar-shaped ground electrode 27 formed of Ni alloy is bonded to the leading end surface of the metal shell intermediate body by resistance welding. Since a so-called "sagging" is generated during the welding, the "sagging" is removed therefrom, and a screw portion is formed in a predetermined portion of the metal shell intermediate body by rolling. Accordingly, the metal shell 3 having the ground electrode 27 welded thereto is obtained. Further, the metal shell 3 having the ground electrode 27 welded thereto undergoes zinc plating or nickel plating. Further, in order to improve wear resistance, the surface of the metal shell may further undergo a chromate treatment.

On the other hand, the insulator 2 may be formed by molding separately from the metal shell 3. For example, base stock granulated particles are formed by using raw powder containing alumina as a main component and a binder or the like, and rubber press-molding is performed by using the base stock granulated particles, thereby obtaining a cylindrical molded body. Then, grinding is performed on the obtained molded body to have a certain external shape, and the resultant object is baked in a baking furnace, thereby obtaining the insulator 2.

Further, the center electrode 5 is manufactured separately from the metal shell 3 and the insulator 2. That is, the center electrode 5 is manufactured by performing forging on Ni alloy having copper alloy disposed at the center portion thereof to improve heat radiation performance. Subsequently, the noble metal portion 31 formed of noble metal alloy is bonded to the leading end portion of the center electrode 5 by laser welding or the like.

Subsequently, the insulator 2, the center electrode 5, the resistor 7, and the terminal electrode 6 obtained as described above are sealed and fixed to each other by the glass seal layers 8 and 9. Generally, the glass seal layers 8 and 9 may be formed in such a manner that metal powder is mixed with borosilicate glass, the resultant object is injected into the axial hole 4 of the insulator 2 with the resistor 7 interposed therebetween, and the injected object is heated to be baked and hardened in a baking furnace while suppressing the rear side using the terminal electrode 6. Further, at this time, a lustering agent layer may be simultaneously formed on the surface of the rear end side body portion 10 of the insulator 2, or the lustering agent layer may be formed thereon in advance.

Then, the insulator 2 having the center electrode 5 and the terminal electrode 6 separately manufactured as described above is assembled to the metal shell 3 having the ground electrode 27. More specifically, the insulator is fixed by caulking the rear end side opening of the metal shell 3 toward the inside of the radial direction, that is, forming the caulking portion 20.

Subsequently, the hole portion 43 is formed in the leading end portion of the ground electrode 27, and the noble metal chip 41 is bonded to the ground electrode 27 by a laser beam or an electron beam.

Further, the depth of the hole portion 43 is adjusted so that the distance B1 becomes a predetermined size or more.

The welding of the noble metal chip 41 with respect to the ground electrode 27 will be described in detail. The noble metal chip 41 is supported by a predetermined pressing pin while the noble metal chip 41 is placed on the bottom surface of the hole portion 43 of the ground electrode 27. Subsequently, a high-energy laser beam such as a fiber laser or an electron beam is emitted from the leading end surface of the ground electrode 27 to the contact surface between the ground electrode 27 and the noble metal chip 41 while moving the laser emission position in the width direction of the ground electrode 27. Accordingly, the fusion portion 35 is formed, and the noble metal chip 41 is bonded to the ground electrode 27.

Further, in the embodiment, the emission condition of the laser beam or the like is set so that 70% or more of the bottom surface of the noble metal chip 41 is bonded to the ground electrode 27, and the edge portion of the fusion portion 35 intrudes into the body portion 27M of the ground electrode 27. Further, when the outer diameter of the noble metal chip 41 or the material of the noble metal chip 41 is different, the output or the emission time of the laser beam or the like and the emission method of the laser beam or the like (whether the laser is used as a continuous wave or an intermittent wave (pulse)) are appropriately controlled, whereby 70% or more of the bottom surface of the noble metal chip 41 may be bonded to the ground electrode 27.

After the bonding of the noble metal chip 41, the substantial center portion of the ground electrode 27 is bent toward the center electrode 5. Then, the size of the spark discharge gap 33 between the noble metal portion 31 and the noble metal chip 41 is controlled, whereby the above-described spark plug 1 is obtained.

As described above in detail, according to the embodiment, the noble metal chip 41 is bonded to the hole portion 43 of the ground electrode 27 through the fusion portion 35 formed by emitting a laser beam or the like from its side surface. Accordingly, the fusion portion 35 may be suppressed from being exposed to the spark discharge gap 33, and a degradation of the wear resistance or the ignition performance may be more reliably prevented.

Further, since 70% or more of the bottom surface of the noble metal chip 41 is bonded to the ground electrode 27, a difference in the thermal stress between the noble metal chip 41 and the ground electrode 27 caused by thermal expansion may be more reliably absorbed by the fusion portion 35.

The gap 45 is provided between the noble metal chip 41 and at least a part of the inner wall surface 43S of the hole portion 43, and the noble metal chip 41 may be thermally expanded toward the side surface thereof at the time of using (heating) the spark plug. Accordingly, a difference in the thermal stress generated between the noble metal chip 41 and the ground electrode 27 may be more reliably reduced.

On the other hand, since the size of the gap 45 is set to be 1.0 mm or less in the direction perpendicular to the central axis CL2 of the noble metal chip 41 so as not to become excessively large, heat may be more highly efficiently transferred from the noble metal chip 41 to the ground electrode 27. As a result, a difference in the thermal stress generated between the noble metal chip 41 and the ground electrode 27 may be further reduced at the time of using the spark plug.

That is, according to the embodiment, since the gap 45 is provided, the thermal expansion of the noble metal chip 41 toward its side surface is permitted, and the gap 45 is prevented from becoming excessively large, thereby efficiently transferring heat from the noble metal chip 41. Accordingly, a difference in the thermal stress between the noble metal chip 41 and the ground electrode 27 may be sufficiently reduced, and the difference in the thermal stress may be effectively absorbed by the comparatively wide fusion portion 35. As a result, the generation of oxidized scale at the boundary portion between the noble metal chip 41 and the ground electrode 27 may be more reliably prevented, and the peeling resistance of the noble metal chip 41 may be noticeably improved.

Further, at least a part of a portion located at the opposite side of the exposed surface 35E in the fusion portion 35 is formed to intrude into the body portion 27M of the ground electrode 27, and the edge portion of the fusion portion 35 is held by the body portion 27M. Further, the maximum value of the distance B1 is set to 0.05 mm or more, and the maximum value of the distance C1 is set to 0.05 mm or more. For this reason, the thermal expansion of the fusion portion 35 may be extremely effectively suppressed, and a difference in the thermal stress generated between the fusion portion 35 and the ground electrode 27 may be effectively reduced. As a result, the generation of oxidized scale between the fusion portion 35 and the ground electrode 27 may be further suppressed, and the peeling resistance may be truly improved.

Further, since the fusion portion 35 is formed so as to be located at the leading end side of the ground electrode 27 in relation to the bent portion 27B, a degradation of breakage resistance of the ground electrode 27 may be more reliably prevented.

In addition, the fusion portion 35 is formed so as not to be exposed to the surface except for the surface provided with the hole portion 43 and the surface to which a laser beam or the like is emitted in the side surface and the leading end surface of the ground electrode 27. Accordingly, a degradation of ignition performance or wear resistance may be more reliably prevented.

Further, since the fusion portion 35 is not exposed to the discharge surface of the noble metal chip 41, an improvement in the wear resistance using the noble metal chip 41 may be more reliably exhibited.

Further, since fiber laser is used as a laser beam, a melted portion in the noble metal chip 41 when bonding the noble metal chip may be further decreased. Even when a comparatively thin noble metal chip 41 is used as in the embodiment, the noble metal chip 41 may have a sufficient thickness (volume) after the bonding. That is, since the fiber laser is used as the laser beam, the comparatively thin noble metal chip 41 is used, so that an increase in the manufacturing cost may be suppressed, and wear resistance may be improved.

Second Embodiment

Next, a second embodiment will be described on the basis of points different from the first embodiment.

Figure 5:
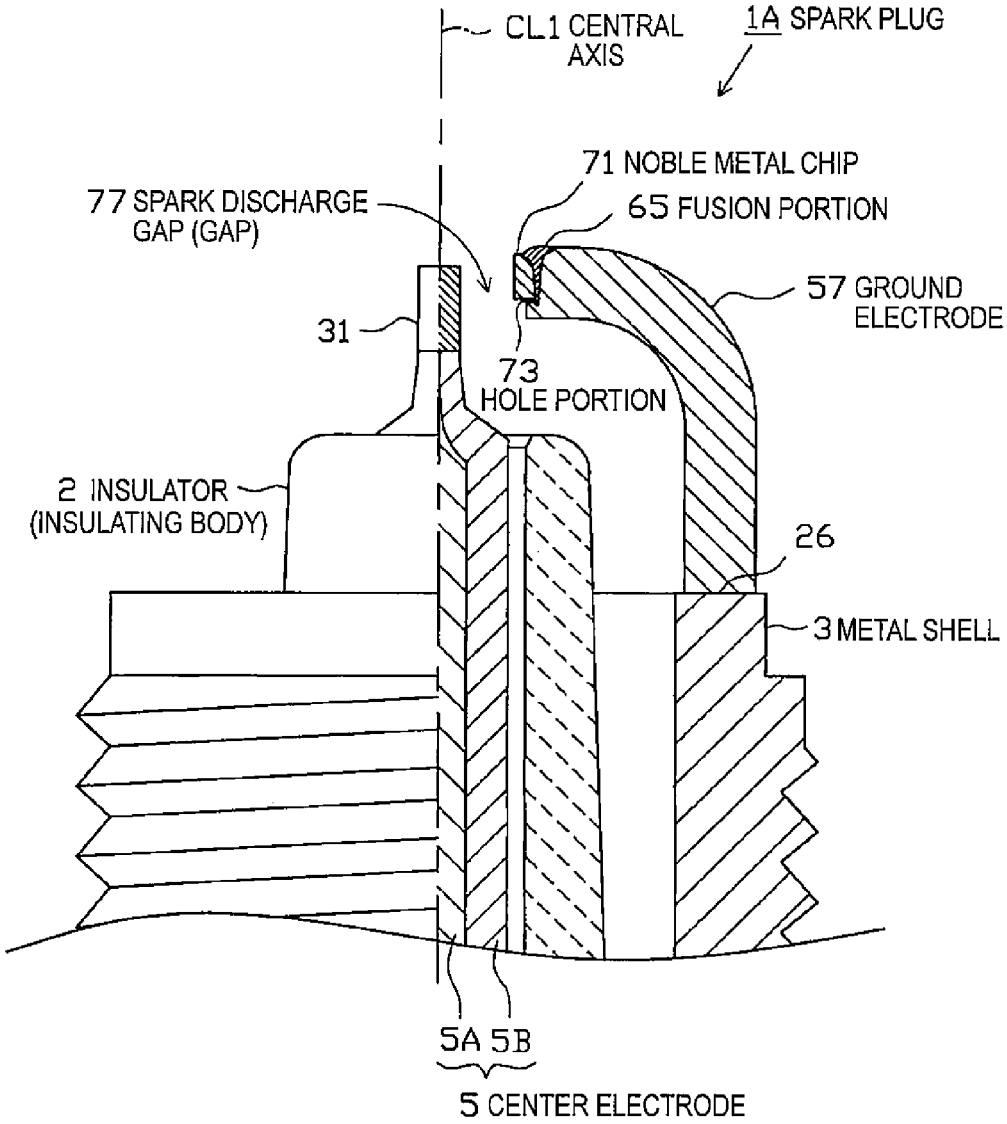
FIG. 5 is a partially cutaway enlarged front view illustrating a configuration of a leading end portion of a spark plug of a second embodiment.

A spark plug 1A of the second embodiment has a configuration in which a leading end surface of a ground electrode 57 faces the side surface of the center electrode 5 (the noble metal portion 31) as shown in FIG. 5. Then, a concave hole portion 73 is formed in the leading end surface of the ground electrode 57, and a noble metal chip 71 is bonded to the hole portion 73 through a fusion portion 65. The fusion portion 65 is formed by emitting a laser beam or an electron beam from the side surface of the noble metal chip 71 to the side surface of the ground electrode 27. Further, a spark discharge gap 77 is formed between the noble metal chip 71 and the side surface of the center electrode 5 (the noble metal portion 31), and a spark discharge is performed in the direction substantially perpendicular to the central axis CL1 in the spark discharge gap 77. That is, the spark plug 1A of the second embodiment is of a so-called transverse electric discharge type.

Figure 6:
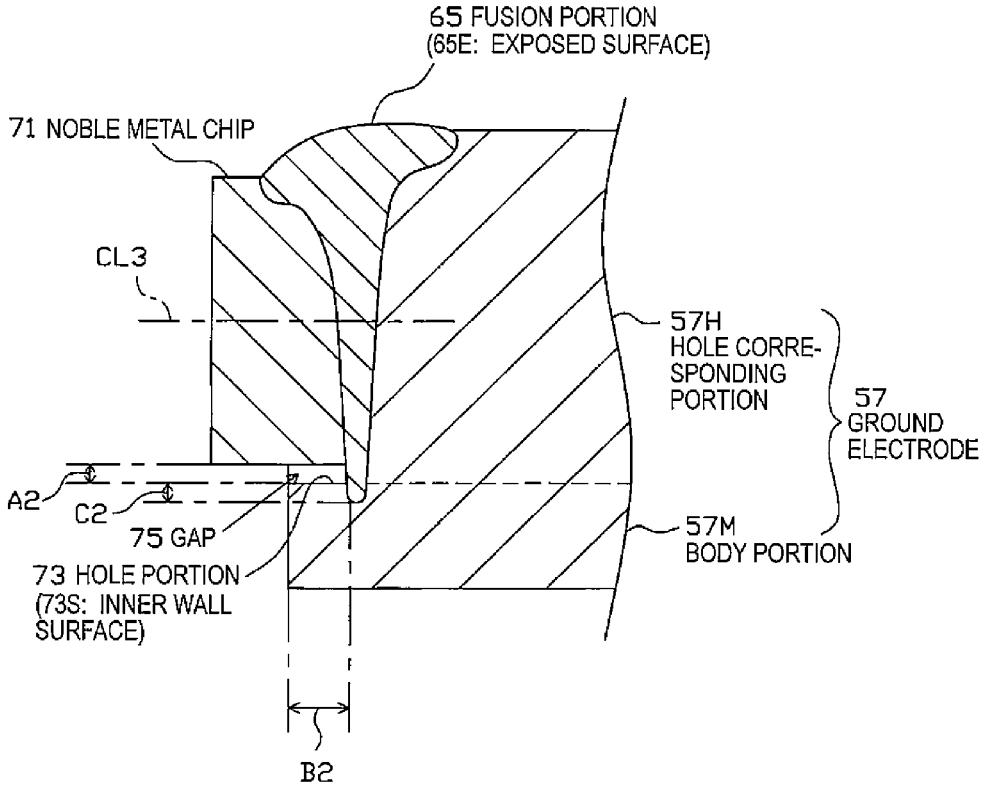
FIG. 6 is a partially enlarged cross-sectional view illustrating a configuration of a noble metal chip, a ground electrode, or the like of the second embodiment.

Further, as shown in FIG. 6, a gap 75 is provided between the noble metal chip 71 and at least a part of the inner wall surface 73S of the hole portion 73. The gap 75 is formed so that the size A2 in the direction perpendicular to the central axis CL3 of the noble metal chip 71 is set to be more than 0 mm and equal to or less than 1.0 mm (for example, the range equal to or more than 0.01 mm and equal to or less than 0.5 mm).

Further, as in the first embodiment, the ground electrode 57 includes a hole corresponding portion 57H that corresponds to the hole portion 73 and a body portion 57M except for the hole corresponding portion 57H. Then, at least a part of the fusion portion 65 located at the opposite side of an exposed surface 65E in relation to the end portion located at the side of the exposed surface 65E in the noble metal chip 71 in the direction perpendicular to the exposed surface 65E of the fusion portion 65 is disposed inside the body portion 57M of the ground electrode 57.

Then, the maximum value of the distance B2 between the surface on the side of the spark discharge gap 77 of the body portion 57M and the edge portion of the portion intruding into the body portion 57M in the fusion portion 65 along the central axis CL3 of the noble metal chip 71 is set to 0.05 mm or more.

Further, the maximum value of the distance C2 between the inner wall surface 73*s* of the hole portion 73 and the edge portion of the portion intruding into the body portion 57M in the fusion portion 65 in the direction perpendicular to the central axis CL3 of the noble metal chip 71 is set to 0.05 mm or more.

As described above, according to the second embodiment, the same effect as that of the first embodiment may be basically obtained. That is, in the so-called transverse electric discharge type spark plug 1A, peeling resistance or the like of the noble metal chip 71 may be noticeably improved.

Subsequently, in order to check the effect of the above-described embodiments, a sample (corresponding to a comparative example) of the spark plug was manufactured in which the fusion ratio of the bottom surface of the noble metal chip with respect to the ground electrode was set to 50%, and the gap A (mm) between the inner wall surface of the hole portion and the noble metal chip was variously changed. Then, a sample (corresponding to the embodiment) of the spark plug was manufactured in which the fusion ratio was set to 70%, and the size of the gap A was variously changed. Subsequently, a lab cooling test for each sample was performed. The outline of the lab cooling test is as below. That is, one cycle was set such that the sample was heated by a burner so that the temperature of the noble metal chip became 900° C. under the presence of the atmosphere, and was gradually cooled for one minute. Then, 1000 cycles were performed. After 1000 cycles, the cross-section of the sample was observed so as to measure the ratio (the ratio of the oxidized scale) of the length of the oxidized scale formed at a boundary surface between the noble metal chip, the fusion portion, and the ground electrode with respect to the length of the boundary surface. Here, the sample having the oxidized scale ratio of 30% or less was evaluated as "©" indicating that the peeling resistance of the noble metal chip was truly excellent, and the sample having the oxidized scale ratio more than 30% and equal to or less than 50% was evaluated as "O" indicating that the peeling resistance was excellent. On the other hand, the sample having the oxidized scale ratio more than 50% was evaluated as "x" indicating that the peeling resistance was poor. Table 1 shows the test result of the lab cooling test for each sample. Further, the sample having 0.0 mm of a gap A indicates that the inner wall surface of the hole portion comes into close contact with the side surface of the noble metal chip. Further, in all samples shown in the test below, the outer diameter of the noble metal chip was 1.0 mm, the thickness thereof was 0.4 mm, the thickness of the ground electrode was 1.5 mm, and the width of the surface facing the center electrode was 2.8 mm.

TABLE 1

| | EVALUATION | |
|---|---|---|
| GAP A(mm) | 50% OF FUSION RATIO | 70% OF FUSION RATIO |
| 0.0 | X | X |
| 0.01 | X | © |
| 0.2 | X | © |
| 0.5 | X | © |
| 1.0 | X | O |
| 1.1 | X | x |

As shown in Table 1, in the sample having 50% of the fusion ratio of the bottom surface of the noble metal chip with respect to the ground electrode, the oxidized scale ratio was more than 50%, and hence the peeling resistance of the noble metal chip was poor. This is because a difference in the thermal stress generated between the noble metal chip and the ground electrode may not be sufficiently absorbed by the comparatively narrow fusion portion, so that the generation of oxidized scale may not be sufficiently prevented.

Further, in the sample having 70% of the fusion ratio, even when the gap A was 0.0 mm, the peeling resistance was not sufficient. This is because the thermal expansion of the noble metal chip toward the side surface thereof is regulated due to the noble metal chip coming into close contact with the inner wall surface of the hole portion, so that a large difference in the thermal stress is generated at the boundary portion between the bottom surface of the noble metal chip and the ground electrode and the like.

Further, in the sample having 70% of the fusion ratio, even when the gap A was more than 1.0 mm, the peeling resistance was poor. This is because the heat of the noble metal chip is not efficiently transferred to the ground electrode due to the excessively large gap between the inner wall surface of the hole portion and the noble metal chip, so that a difference in the thermal stress therebetween becomes very large.

On the contrary, in the sample in which the fusion ratio was 70% and the gap A was more than 0.0 mm and equal to or less than 1.0 mm, the oxidized scale ratio was 50% or less, and hence excellent peeling resistance may be obtained. This is because a gap is provided between the inner wall surface of the hole portion and the noble metal chip so as to permit the thermal expansion of the noble metal chip toward its side surface, and the gap is set to 1.0 mm or less so as to efficiently transfer heat from the noble metal chip to the ground electrode. Accordingly, a difference in the thermal stress between the noble metal chip and the ground electrode may be sufficiently reduced, and the difference in the thermal stress may be sufficiently absorbed by the comparatively wide fusion portion.

Particularly, in the sample having the gap A equal to or more than 0.01 mm and equal to or less than 0.5 mm, the oxidized scale ratio was 30% or less, and hence the peeling resistance was truly excellent. This is because the thermal transfer from the noble metal chip to the ground electrode is more effectively performed.

According to the above-described test result, it is desirable that a gap is provided between the inner wall surface of the hole portion and the noble metal chip so as to be more than 0.0 mm and equal to or less than 1.0 mm while setting the fusion ratio of the bottom surface of the noble metal chip with respect to the ground electrode to 70% or more in order to improve the peeling resistance of the noble metal chip. Further, it is more desirable that the size of the gap is set to be equal to or more than 0.01 mm and equal to or less than 0.5 mm from the viewpoint of truly improving the peeling resistance.

Figure 7:
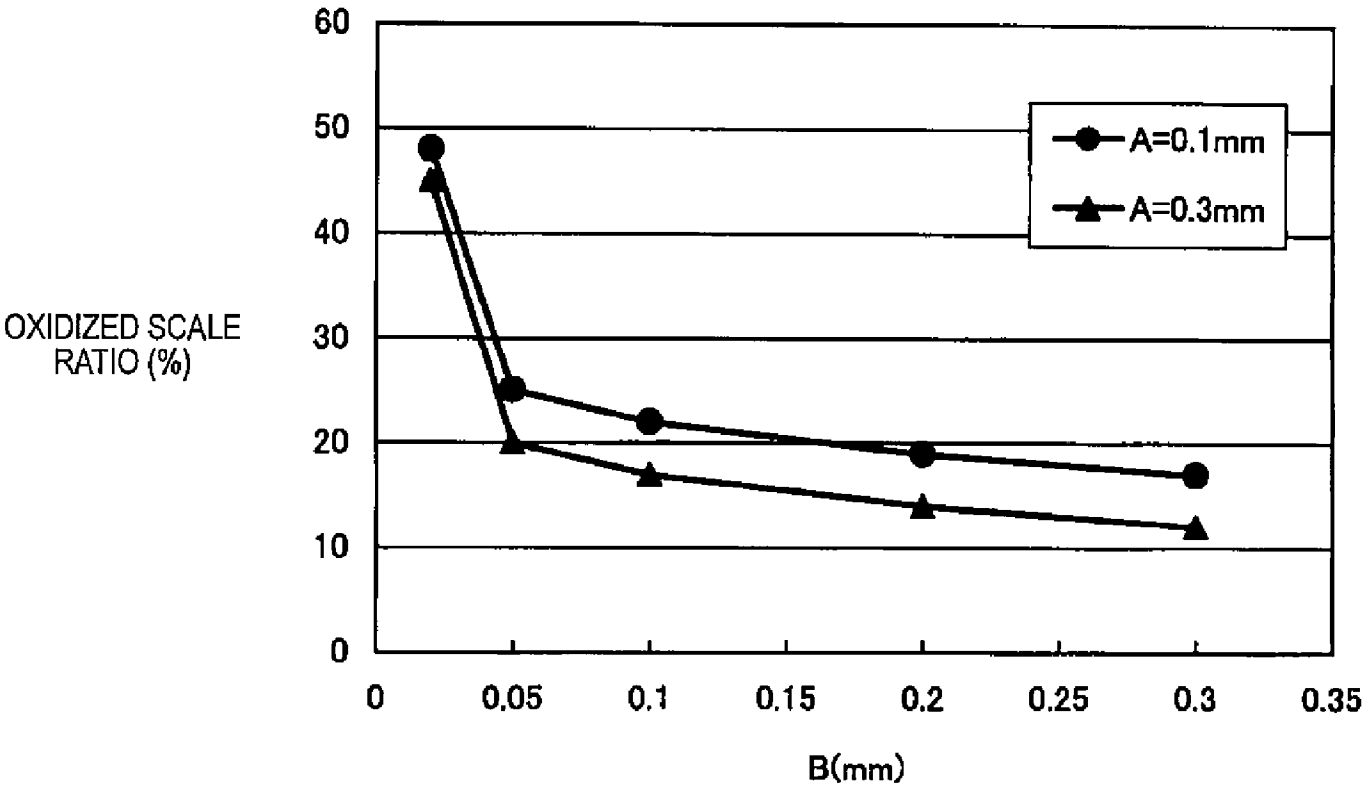
FIG. 7 is a graph illustrating a result of a lab cooling test for a sample in which a distance B is variously changed.

Subsequently, samples of the spark plug were manufactured in which the gap A was set to 0.1 mm or 0.3 mm, and the maximum distance B (mm) between the surface of the body portion located at the spark discharge gap side and the edge portion of the portion intruding into the body portion in the fusion portion (which indicates a fusion portion located at the opposite side of the exposed surface in the direction perpendicular to the exposed surface of the fusion portion in relation to the end portion located at the exposed surface side in the noble metal chip) along the central axis of the noble metal chip was variously changed. Then, the lab cooling test for each sample was performed. FIG. 7 illustrates a relationship between the distance B and the oxidized scale ratio. Further, in FIG. 7, the test result of the sample having the gap A set to 0.1 mm was plotted as a circle, and the test result of the sample having the gap A set to 0.3 mm was plotted as a triangle. Further, in all samples of the test below, the fusion ratio of the bottom surface of the noble metal chip with respect to the ground electrode was set to 70% or more.

As shown in FIG. 7, all samples had sufficient peeling resistance. However, in the sample having the distance B set to 0.05 mm or more, the oxidized scale ratio was 30% or less, and hence the peeling resistance was truly excellent. This is because the edge portion of the fusion portion is more reliably held by the body portion due to the sufficiently large distance B set to 0.05 mm or more, so that the thermal expansion of the fusion portion is effectively suppressed.

According to the above-described test result, it is desirable that at least a part of the fusion portion located at the opposite side of the exposed surface in the direction perpendicular to the exposed surface of the fusion portion in relation to the end portion located at the side of the exposed surface in the noble metal chip is disposed inside the body portion and the distance B is set to 0.05 mm or more in order to further improve the peeling resistance. Further, it is more desirable that the distance B is set to 0.2 mm or more in order to further improve the peeling resistance.

Figure 8A:
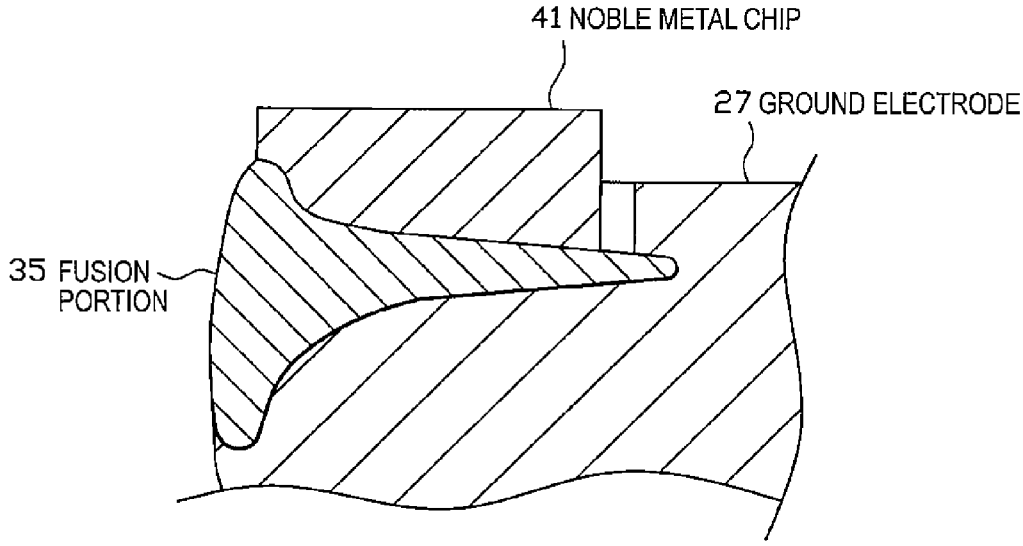
FIG. 8(*a*) and FIG. 8(*b*) are figures showing enlarged cross-sectional schematic views illustrating a portion located on the opposite side of a noble metal chip in a boundary portion between a fusion portion and the ground electrode.
Figure 8B:
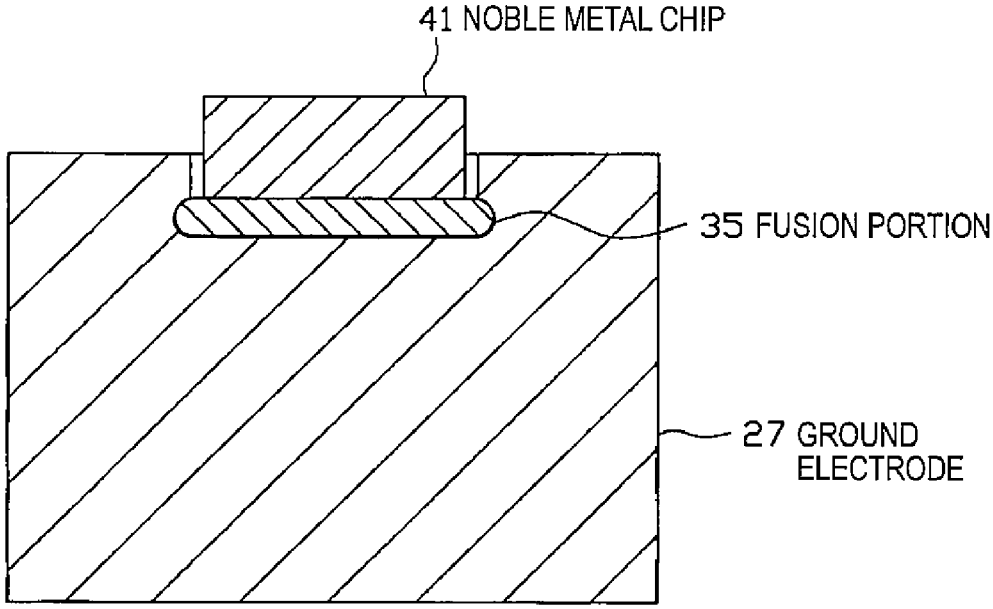

Subsequently, samples of the spark plug were manufactured in which the maximum distance C (mm) between the inner wall surface of the hole portion and the edge portion of the portion intruding into the body portion in the fusion portion (indicating the fusion portion located at the opposite side of the exposed surface in the direction perpendicular to the exposed surface of the fusion portion in relation to the end portion located at the side of the exposed surface in the noble metal chip) in the direction perpendicular to the central axis of the noble metal chip was variously changed. The above-described lab cooling test of each sample was performed in the condition that the heating temperature was set to 1050° C. (that is, in a stricter condition). Here, the cross-section of the sample was observed. The sample in which the oxidized scale (oxidized film) exceeded the edge portion of the fusion portion and reaching the portion (the portion depicted by the bold line in FIGS. 8 (*a*) and (*b*) and causing a worry in that the noble metal chip may be peeled off due to the generation of the oxidized scale) located at the opposite side of the noble metal chip in the boundary portion between the fusion portion and the ground electrode was evaluated as "x" indicating that the peeling resistance was not sufficient. Further, the sample in which the oxidized scale did not reach the above-described portion, but reached the edge portion of the fusion portion was evaluated as "Δ" indicating that the peeling resistance was slightly poor. On the other hand, the sample in which the oxidized scale did not reach the edge portion of the fusion portion was evaluated as "O" indicating that the peeling resistance was extremely excellent. Table 2 shows the test result. Further, in all samples, the gap A was set to 0.1 mm.

TABLE 2

| DISTANCE C (mm) | EVALUATION |
|---|---|
| 0.01 | x |
| 0.02 | Δ |
| 0.05 | O |
| 0.5 | O |
| 1.0 | O |

As shown in Table 2, in the sample having the distance C set to be less than 0.05 mm, the oxidized scale reached the edge portion of the fusion portion, and hence the sufficient peeling resistance was not ensured.

On the contrary, in the sample having the sufficiently large distance C set to 0.05 mm or more, the oxidized scale did not reach the edge portion of the fusion portion, and hence the peeling of the noble metal chip was effectively prevented. This is because a sufficient distance is ensured between the edge portion of the fusion portion and the position (the boundary portion between the fusion portion and the inner wall surface of the hole portion) into which oxygen intrudes due to the sufficiently large distance C.

Figure 9A:
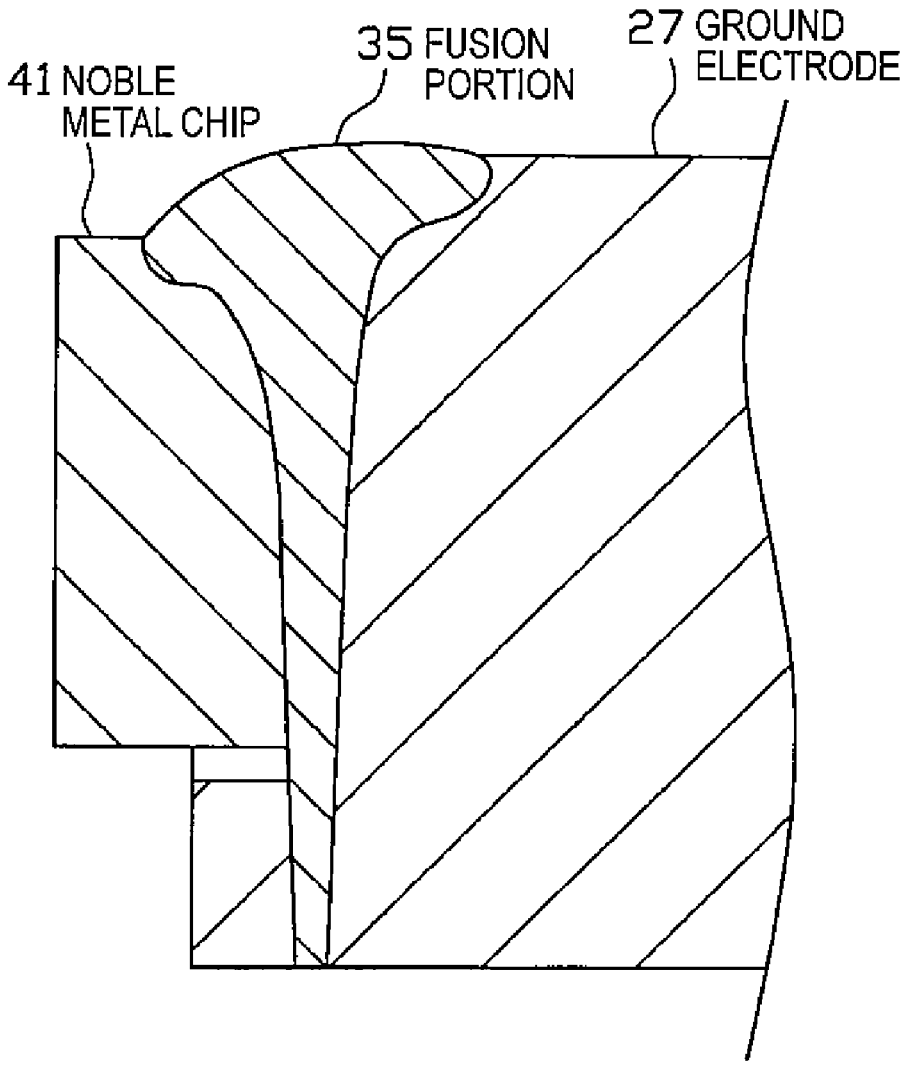
FIG. 9(*a*) and FIG. 9(*b*) are figures showing enlarged cross-sectional schematic views illustrating an example of a fusion portion in which a portion except for an exposed surface is exposed to a surface of the ground electrode.
Figure 9B:
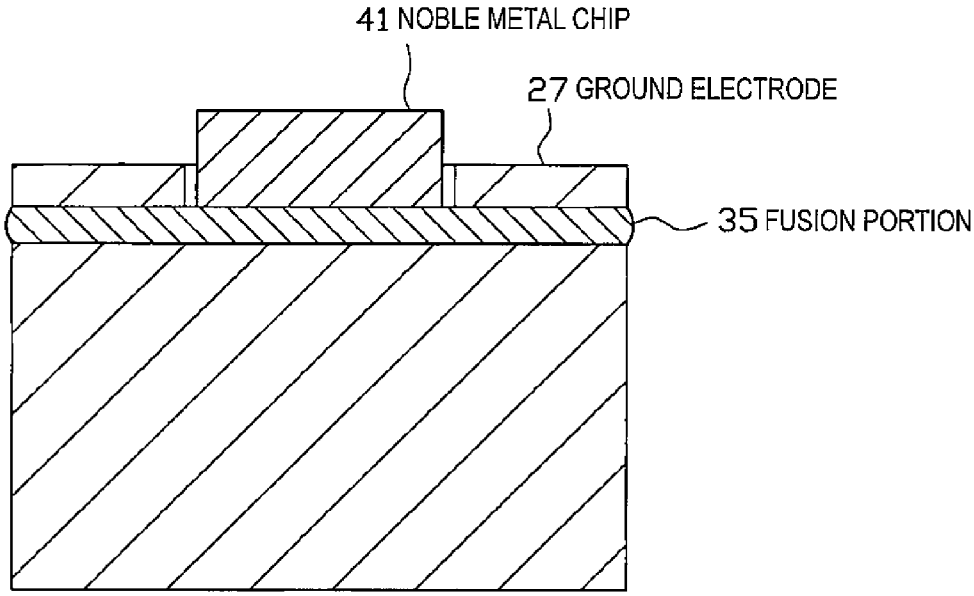

However, as shown in FIGS. 9(*a*) and (*b*), when the distance C was set to be excessively large, and the portion except for the exposed surface as the position irradiated with a laser beam or the like in the fusion portion was exposed to the surface of the ground electrode, the oxidized scale was generated from the exposed portion, and hence the peeling resistance was degraded.

Further, when a laser beam was emitted from the leading end surface of the ground electrode so that the fusion portion reached the bent portion of the ground electrode, the strength of the ground electrode was degraded, and hence the wear resistance with respect to the vibration was degraded.

According to the above-described test result, it is desirable that at least a part of the fusion portion located at the opposite side of the exposed surface in relation to the end portion located at the side of the exposed surface in the noble metal chip in the direction perpendicular to the exposed surface of the fusion portion intrudes into the body portion, and the distance C is set to be 0.05 mm or more in order to improve the peeling resistance of the noble metal chip.

However, when the portion except for the exposed surface of the fusion portion is exposed to the surface of the ground electrode or the fusion portion reaches the bent portion of the ground electrode, there are concerns in that the peeling resistance improving effect is not sufficiently exhibited and the wear resistance is degraded. Accordingly, it is desirable to set the distance C in consideration of this point.

Subsequently, a sample (sample A) was manufactured in which the fusion portion was exposed to the surface (discharge surface) provided with the spark discharge gap in the noble metal chip by changing the emission energy or the emission position of the laser beam, and a sample (sample B) was manufactured in which the fusion portion is not exposed to the discharge surface by changing the emission energy or the emission position of the laser beam. A lab spark test for both samples was performed. Further, the outline of the lab spark test is as below. That is, the frequency of the application voltage to the sample was set to 100 Hz (that is, electric discharge was performed 6000 times per minute), and electric discharge of each sample was performed for 100 hours under the presence of 0.4 MPa of atmosphere. Then, after 100 hours, the consumed volume of the noble metal chip (the fusion portion) with the spark discharge was measured. Table 3 shows the test result of the test.

TABLE 3

| | CONSUMED VOLUME ($mm^3$) |
|---|---|
| SAMPLE A | 0.1 |
| SAMPLE B | 0.2 |

As shown in Table 3, in the sample (sample A) in which the fusion portion is not exposed to the discharge surface, the consumed volume is comparatively small, and the wear resistance is excellent. Accordingly, it is desirable that the fusion portion is not exposed to the discharge surface in order to improve the wear resistance.

Further, the invention is not limited to the above-described embodiments, but for example, may be embodied as below. Of course, the invention may be applied to other application examples and modified examples not illustrated below.

Figure 10:
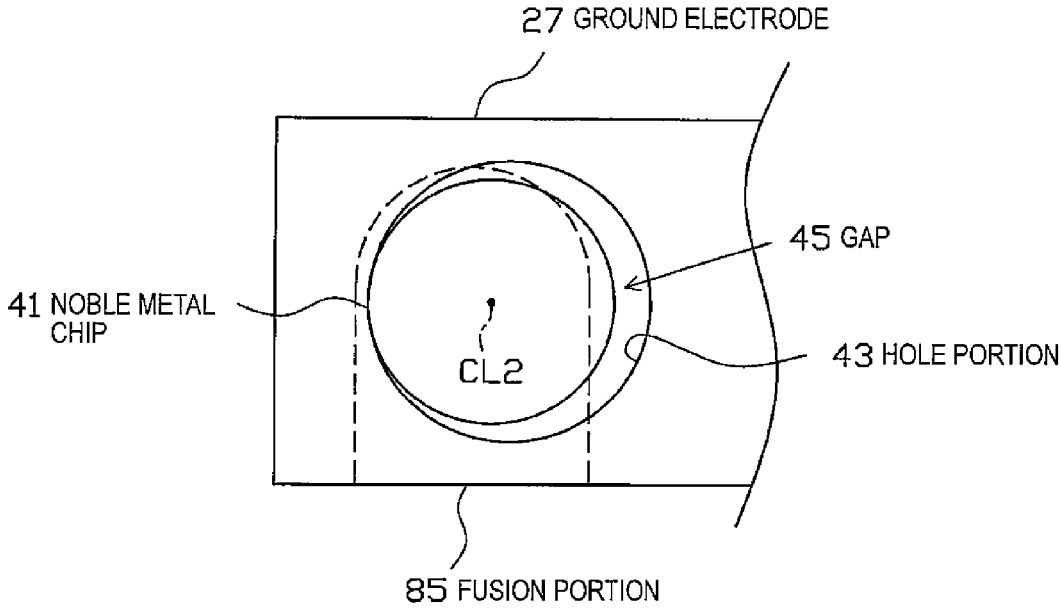
FIG. 10 is a partially enlarged plan view illustrating a configuration of a fusion portion of another embodiment.

(a) In the above-described first embodiments, the fusion portion 35 is formed by emitting a laser beam or the like to the leading end surface of the ground electrode 27. However, as shown in FIG. 10, a fusion portion 85 may be formed by emitting a laser beam or the like to the side surface of the ground electrode 27, and the noble metal chip 41 may be bonded to the ground electrode 27. Further, the fusion portion may be formed by emitting a laser beam or the like to plural surfaces (for example, the opposite surfaces) in addition to one surface of the ground electrode 27.

Figure 11:
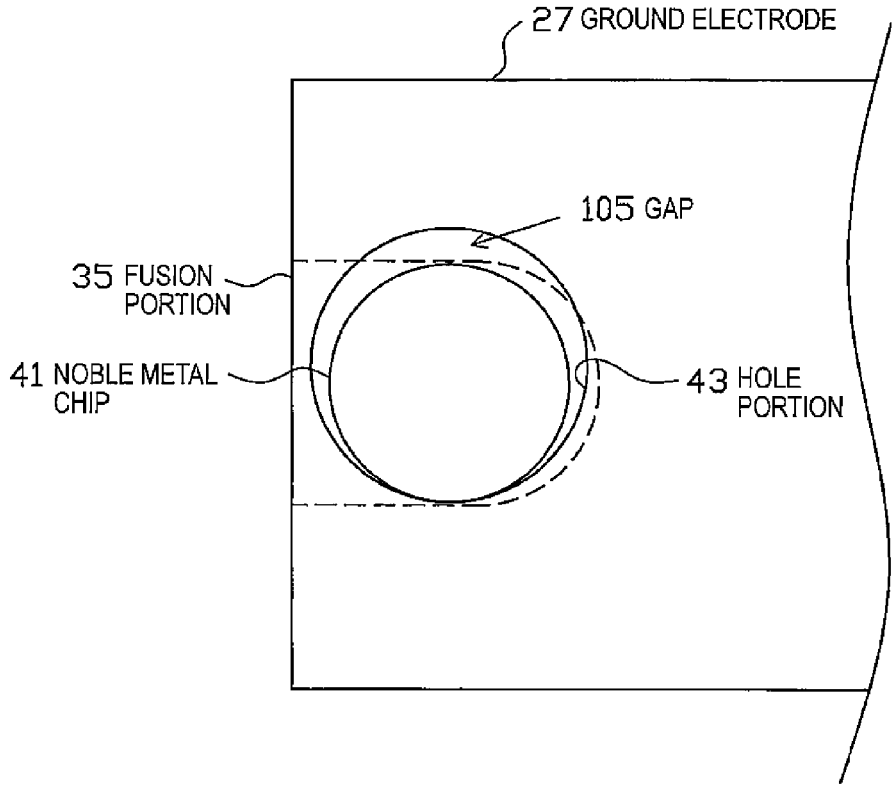
FIG. 11 is a partially enlarged plan view illustrating a configuration of the gap of another embodiment.

(b) In the above-described embodiments, the size A1 of the gap 45 is set to be maximal at the base end side of the ground electrode 27. However, the position having the maximum size of the gap 45 is not particularly limited so long as the noble metal chip 41 is thermally expanded toward its side surface at the time of heating the spark plug. Accordingly, for example, as shown in FIG. 11, the correlation between the noble metal chip 41 and the hole portion 43 may be set so that the size of the gap 105 becomes maximal at the side of the side surface of the ground electrode 27.

Figure 12:
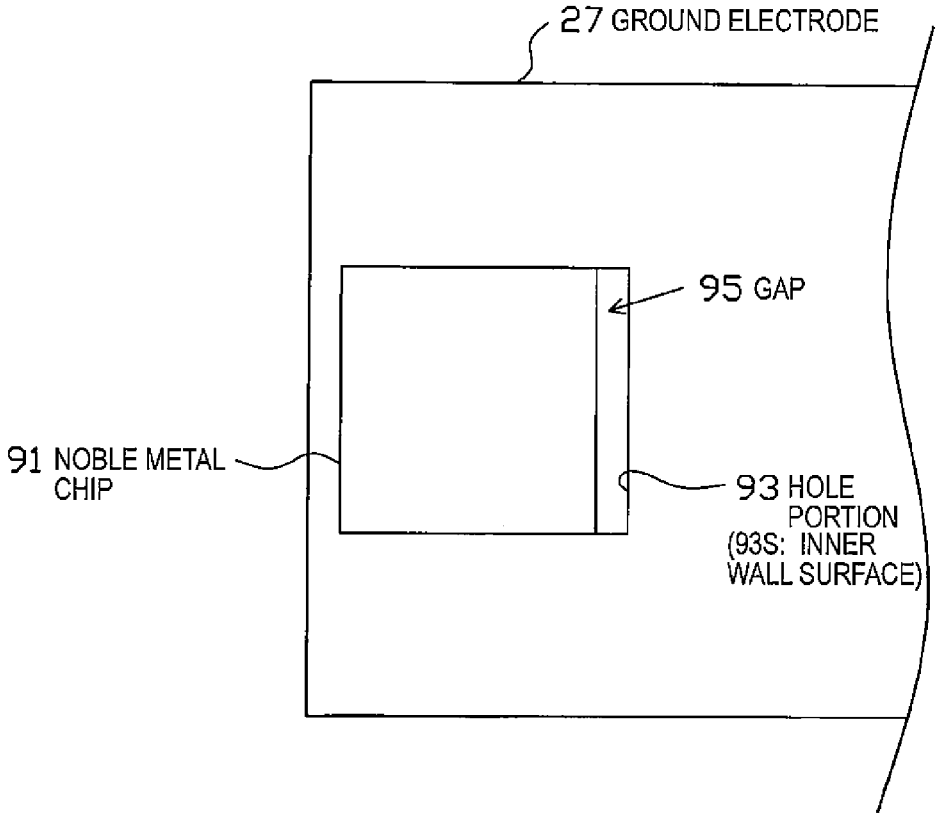
FIG. 12 is a partially enlarged plan view illustrating a configuration of the noble metal chip or the like of another embodiment.

(c) In the above-described embodiments, the noble metal chip 41 is formed in a column shape, but the shape of the noble metal chip is not limited thereto. Accordingly, as shown in FIG. 12, a noble metal chip 91 may be formed in a rectangular shape. Further, in order to correspond to the noble metal chip 91 having such a shape, a gap 95 may be provided between an inner wall surface 93S of a hole portion 93 and a noble metal chip 91 by forming the hole portion 93 so as to form a rectangular space.

Figure 13:
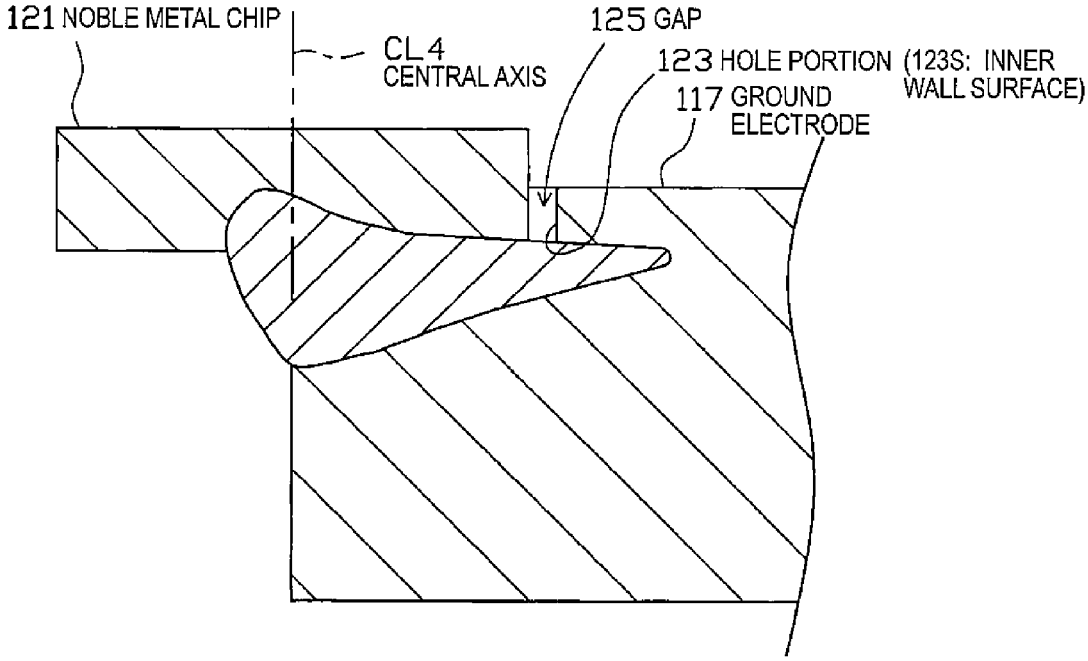
FIG. 13 is a partially enlarged cross-sectional view illustrating a configuration of the noble metal chip or the like of another embodiment.

(d) In the above-described embodiments, although it is not particularly described, as shown in FIG. 13, a noble metal chip 121 may be provided so as to protrude from the leading end surface of the ground electrode 117. In this case, since the ground electrode 117 is prevented from being an obstacle to the growth of the flame, the ignition performance may be improved. However, in this case, it may be difficult to transfer the heat of the noble metal chip 121 to the ground electrode 117. For this reason, it is desirable that a gap 125 formed between an inner wall surface 123S of a hole portion 123 and a side surface of the noble metal chip 121 is set to be comparatively small in order to efficiently transfer the heat from the noble metal chip 121 to the ground electrode 117. Accordingly, for example, it is desirable that the maximum value of the size of the gap 125 in the direction perpendicular to the central axis CL4 of the noble metal chip 121 is set to be 0.5 mm or less.

Figure 14:
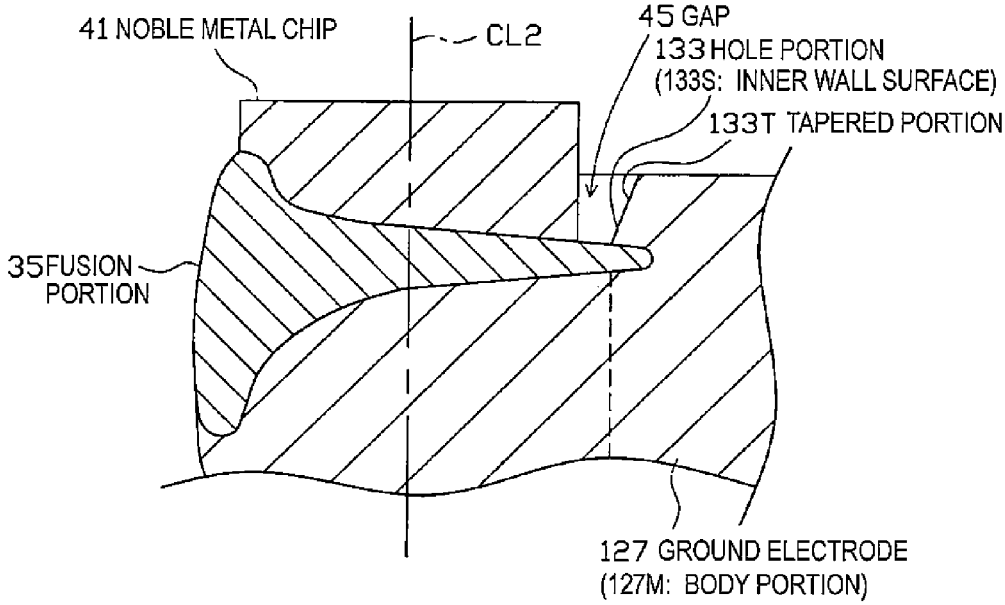
FIG. 14 is a partially enlarged cross-sectional view illustrating a configuration of a hole portion of another embodiment.
Figure 15:
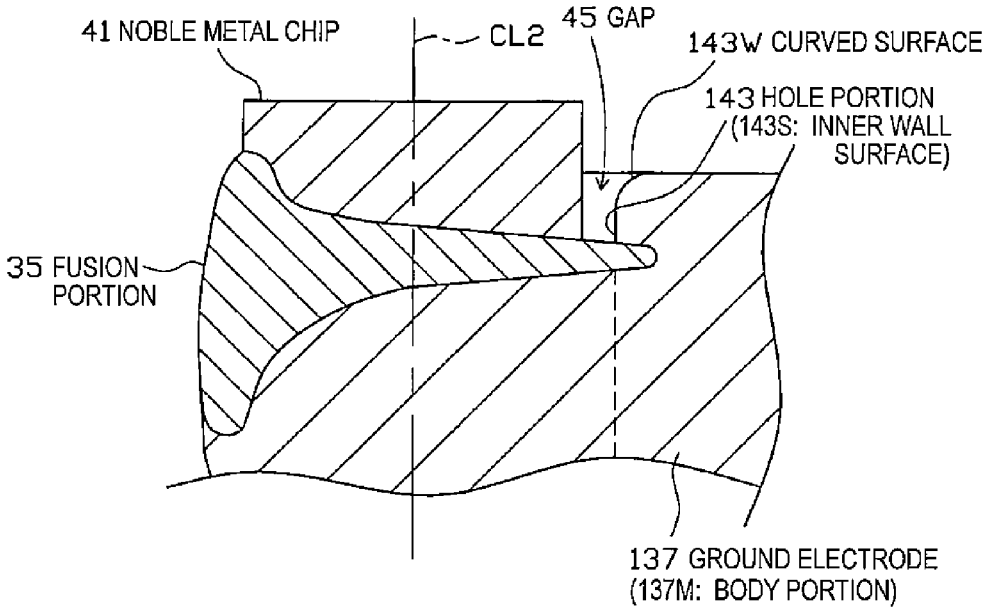
FIG. 15 is a partially enlarged cross-sectional view illustrating a configuration of a hole portion of another embodiment.

(e) In the above-described embodiments, the side surface of the noble metal chip 41 is substantially parallel to the inner wall surface 43S of the hole portion 43, and the inner wall surface 43S is substantially perpendicular to the surface of the body portion 27M. On the contrary, as shown in FIG. 14, at least a part of a surface connected to a surface of a body portion 127M of a ground electrode 127 in an inner wall surface 133S of a hole portion 133 may be provided with a tapered portion 133T gradually becoming closer to the noble metal chip 41 as it reaches the bottom surface of the hole portion 133, and an angle on the side of the ground electrode 27 in an angle formed by the outline of the tapered portion 133T and the outline of the body portion 127M may be an obtuse angle in the cross-section including the central axis CL2 of the noble metal chip 41. Further, as shown in FIG. 15, at least a part of the surface forming the gap 45 with respect to the noble metal chip 41 in the inner wall surface 143S of the hole portion 143 and the surface of the ground electrode 137 (the body portion 137M) may be connected to each other through a convex curved surface 143W. In this case, the electric field strength of the portion between the surface of the body portion 127M (137M) and the inner wall surface 133S (143S) may be degraded. As a result, abnormal spark discharge between the above-described portion and the center electrode 5 (the noble metal portion 31) may be effectively suppressed, and the ignition performance may be improved.

(f) In the above-described embodiments, the ground electrode 27 is formed of a single alloy. However, the ground electrode 27 may be formed as a multi-layer structure having an outer layer and an inner layer by forming the inner layer inside the ground electrode 27 by using copper or copper alloy having excellent thermal conductivity.

(g) In the above-described embodiments, there are described the spark plug 1 in which spark discharge is performed in the direction substantially along the axis line CL1 in the spark discharge gap 33 and the spark plug 1A in which spark discharge is performed in the direction substantially perpendicular to the central axis CL1 in the spark discharge gap 77. However, the technical concept of the invention may be applied to a spark plug in which spark discharge is performed in the direction inclined with respect to the central axis CL1.

(h) In the above-described embodiments, a case has been described in which the ground electrode 27 is bonded to the leading end portion 26 of the metal shell 3. However, the invention may be applied to a case in which the ground electrode is formed by cutting a part (or a part of the leading end fitting welded to the metal shell in advance) of the metal shell (for example, JP-A-2006-236906 and the like).

(i) In the above-described embodiments, the tool engagement portion 19 is formed to have a hexagonal cross-section, but the shape of the tool engagement portion 19 is not limited thereto. For example, the tool engagement portion may be formed in a Bi-HEX (dodecagonal) shape (ISO22977=2005 (E)) or the like.

REFERENCE SIGNS LIST

1: SPARK PLUG
2: INSULATOR (INSULATING BODY)
3: METAL SHELL
4: AXIAL HOLE
5: CENTER ELECTRODE
27: GROUND ELECTRODE
27B: BENT PORTION
27H: HOLE CORRESPONDING PORTION
27M: BODY PORTION
33: SPARK DISCHARGE GAP (GAP)
35: FUSION PORTION
35E: EXPOSED SURFACE
41: NOBLE METAL CHIP

43: HOLE PORTION
45: GAP
CL1: CENTRAL AXIS
CL2: CENTRAL AXIS (OF NOBLE METAL CHIP)

The invention claimed is:

1. A spark plug comprising:

a cylindrical insulating body which has an axial hole penetrating the insulating body in an axial direction;

a center electrode which is inserted to a leading end portion of the axial hole;

a cylindrical metal shell which is provided in an outer periphery of the insulating body;

a ground electrode which is disposed at a leading end portion of the metal shell; and a noble metal chip which is bonded to a leading end portion of the ground electrode and forms a spark gap between the noble metal chip and a leading end portion of the center electrode, wherein the ground electrode has a hole corresponding portion with a concave hole portion in at least one of a leading end surface and a side surface of the leading end portion of the ground electrode, wherein 70% or more of a bottom surface of the noble metal chip is bonded to the hole portion of the ground electrode through a fusion portion formed by fusing the noble metal chip and the ground electrode to each other by irradiating a laser beam or an electron beam from a side surface of the noble metal chip, and wherein a space gap is provided between the noble metal chip and at least a part of an inner wall surface of the hole portion so as to be more than 0 mm and equal to or less than 1.0 mm in a direction perpendicular to a central axis of the noble metal chip.

2. The spark plug according to claim 1, wherein the ground electrode has a body portion which is a portion except for the hole corresponding portion, wherein the fusion portion has an exposed surface exposed to the has an exposed surface which is irradiated with the laser beam or the electron beam, and which is exposed on a surface of the ground electrode, and wherein at least a part of a portion located at an opposite side of the exposed surface in the fusion portion in relation to an end portion at a side of the exposed surface of the noble metal chip in a direction perpendicular to the exposed surface intrudes into the body portion.

3. The spark plug according to claim 2, wherein a maximum value of a distance between a surface of the body portion at a side of the spark gap and an edge portion of the portion intruding into the body portion in the fusion portion in the direction along the central axis of the noble metal chip is set to be 0.05 mm or more.

4. The spark plug according to claim 2, wherein a maximum value of a distance between the inner wall surface of the hole portion and the edge portion of the portion intruding into the body portion in the fusion portion in the direction perpendicular to the central axis of the noble metal chip is set to be 0.05 mm or more.

5. The spark plug according to claim 1, wherein the ground electrode is bent from a bent portion toward the center electrode, and wherein the fusion portion is formed at a leading end side of the ground electrode in relation to the bent portion.

6. The spark plug according to claim 1, wherein the fusion portion is not exposed on a surface except for the surface provided with the hole portion and a surface irradiated with the laser beam or the electron beam in the leading end surface and the side surface of the ground electrode.

7. The spark plug according to claim 1, wherein the fusion portion is not exposed on a surface, which forms the spark gap, of the noble metal chip.

8. The spark plug according to claim 1, wherein a tapered portion, which gradually becomes closer to the noble metal chip as the tapered portion goes toward a bottom surface side of the hole portion, is formed in the inner wall surface of the hole portion on at least a part of a surface that is connected to a surface of the body portion, the space gap is formed between the tapered portion and the noble metal chip, wherein an angle at a side of the ground electrode is set to an obtuse angle in an angle formed by an outline of the body portion and an outline of the tapered portion in a cross-section including the central axis of the noble metal chip.

9. The spark plug according to claim 1, wherein the ground electrode has a body portion which is the portion except for the hole corresponding portion, and wherein a convex curved surface portion is formed in the inner wall surface of the hole portion on at least a part of surface that forms the space gap with the noble metal chip, the inner wall surface of the hole portion is connected to a surface of the body portion through the curved surface portion.

10. The spark plug according to claim 1, wherein the laser beam is a fiber laser.

* * * * *